US008950518B2

(12) United States Patent
Lockwood et al.

(10) Patent No.: US 8,950,518 B2
(45) Date of Patent: Feb. 10, 2015

(54) MATRIX TOOL BODIES WITH EROSION RESISTANT AND/OR WEAR RESISTANT MATRIX MATERIALS

(75) Inventors: Gregory T Lockwood, Pearland, TX (US); Youhe Zhang, Spring, TX (US); Yuri Burhan, Spring, TX (US)

(73) Assignee: Smith International, Inc., Houston, TX (US)

( * ) Notice: Subject to any disclaimer, the term of this patent is extended or adjusted under 35 U.S.C. 154(b) by 1010 days.

(21) Appl. No.: 12/949,350

(22) Filed: Nov. 18, 2010

(65) Prior Publication Data

US 2011/0114394 A1 May 19, 2011

Related U.S. Application Data

(60) Provisional application No. 61/262,476, filed on Nov. 18, 2009.

(51) Int. Cl.

| | |
|---|---|
| ***E21B 10/36*** | (2006.01) |
| ***C22C 1/10*** | (2006.01) |
| ***C22C 26/00*** | (2006.01) |
| ***C22C 29/06*** | (2006.01) |
| ***B22D 19/14*** | (2006.01) |
| ***E21B 10/55*** | (2006.01) |

(52) U.S. Cl.

CPC ..... *E21B 10/55* (2013.01); *C22C 1/1036* (2013.01); *C22C 26/00* (2013.01); *C22C 2204/00* (2013.01); *C22C 29/06* (2013.01); *B22D 19/14* (2013.01)

USPC ..... 175/425; 175/428; 164/97; 264/108

(58) Field of Classification Search

USPC ..... 419/6, 7, 14; 175/507, 509, 425, 428; 51/507, 509; 164/97; 264/108

See application file for complete search history.

(56) References Cited

U.S. PATENT DOCUMENTS

| | | | |
|---|---|---|---|
| 4,119,459 | A | 10/1978 | Ekemar et al. |
| 4,694,919 | A | 9/1987 | Barr |
| 4,723,996 | A | 2/1988 | Brunet et al. |
| 4,804,049 | A | 2/1989 | Barr |
| 4,884,477 | A | 12/1989 | Smith |
| 5,000,273 | A | 3/1991 | Horton et al. |
| 5,011,514 | A | 4/1991 | Cho et al. |

(Continued)

OTHER PUBLICATIONS

Pliable Optimized Wea—POW, The DiaPac Group, Feb. 2009, 1 page, www.diapac.com.

(Continued)

*Primary Examiner* — George Wyszomierski
*Assistant Examiner* — Ngoclan T Mai

(57) ABSTRACT

Methods for manufacturing a matrix tool body comprising placing a first matrix material within a first region of a mold cavity proximate a surface of the mold. A second matrix material may be placed within a second region of the mold cavity positioned inwardly of the first matrix material. The first matrix material and the second matrix material comprise a plurality of hard particles. The plurality of hard particles of the second matrix material have a median particle size that is less than the median particle size of the first matrix material. The plurality of hard particles of the first matrix material and the second matrix material are infiltrated with an infiltration binder to form the tool body. Also included are tool bodies having one or more regions proximate a surface of the tool body comprising an erosion resistant matrix material and/or a wear resistant matrix material.

31 Claims, 8 Drawing Sheets

(56) References Cited

U.S. PATENT DOCUMENTS

| | | | |
|---|---|---|---|
| 5,089,182 | A | 2/1992 | Findeisen et al. |
| 5,090,491 | A | 2/1992 | Tibbitts et al. |
| 5,589,268 | A | 12/1996 | Kelley et al. |
| 5,662,183 | A | 9/1997 | Fang |
| 5,967,248 | A | 10/1999 | Drake |
| 6,089,123 | A | 7/2000 | Chow et al. |
| 6,095,265 | A | 8/2000 | Alsup |
| 6,193,000 | B1 | 2/2001 | Caraway et al. |
| 6,248,149 | B1 | 6/2001 | Massey et al. |
| 6,287,360 | B1 | 9/2001 | Kembaiyan et al. |
| 6,371,226 | B1 | 4/2002 | Caraway |
| 6,372,346 | B1 | 4/2002 | Toth |
| 6,375,706 | B2 | 4/2002 | Kembaiyan et al. |
| 6,461,401 | B1 | 10/2002 | Kembaiyan et al. |
| 6,682,580 | B2 | 1/2004 | Findeisen et al. |
| 6,908,688 | B1 | 6/2005 | Majagi et al. |
| 7,250,069 | B2 | 7/2007 | Kembaiyan et al. |
| 7,278,499 | B2 | 10/2007 | Richert et al. |
| 7,350,599 | B2 | 4/2008 | Lockwood et al. |
| 7,470,341 | B2 | 12/2008 | Keshavan et al. |
| 7,474,341 | B2 | 1/2009 | DeLuca et al. |
| 7,541,090 | B2 | 6/2009 | Gerk et al. |
| 8,323,372 | B1 | 12/2012 | Fang et al. |
| 8,342,268 | B2 | 1/2013 | Lockstedt et al. |
| 2004/0245022 | A1 | 12/2004 | Izaguirre et al. |
| 2005/0230150 | A1 | 10/2005 | Oldham et al. |
| 2005/0275143 | A1 | 12/2005 | Toth |
| 2006/0032335 | A1 | 2/2006 | Kembaiyan |
| 2006/0162967 | A1 | 7/2006 | Brackin et al. |
| 2006/0231293 | A1 | 10/2006 | Ladi et al. |
| 2007/0017160 | A1 | 1/2007 | Caldwell et al. |
| 2007/0102198 | A1 | 5/2007 | Oxford et al. |
| 2007/0102200 | A1 | 5/2007 | Choe et al. |
| 2007/0175669 | A1 | 8/2007 | Liang et al. |
| 2008/0017421 | A1 | 1/2008 | Lockwood |
| 2008/0128951 | A1 | 6/2008 | Lockwood et al. |
| 2008/0164070 | A1 | 7/2008 | Keshavan et al. |
| 2008/0202821 | A1 | 8/2008 | McClain et al. |
| 2008/0230278 | A9 | 9/2008 | Hoffmaster et al. |
| 2008/0282618 | A1 | 11/2008 | Lockwood |
| 2008/0289880 | A1 | 11/2008 | Majagi et al. |
| 2009/0120008 | A1 | 5/2009 | Lockwood et al. |
| 2009/0260893 | A1 | 10/2009 | Sheng et al. |
| 2009/0263646 | A1 | 10/2009 | Gerk et al. |
| 2009/0283333 | A1 | 11/2009 | Lockwood |
| 2010/0116557 | A1 | 5/2010 | Lockwood et al. |
| 2011/0120781 | A1 | 5/2011 | Lockwood et al. |

OTHER PUBLICATIONS

Levy, S., "Construction Calculations Manual", Elsevier, Inc., 2012, pp. 65-66.

MATRIX TOOL BODIES WITH EROSION RESISTANT AND/OR WEAR RESISTANT MATRIX MATERIALS

CROSS-REFERENCE TO RELATED APPLICATIONS

This application claims priority to U.S. Provisional Application No. 61/262,476, filed Nov. 18, 2009, which is hereby incorporated by reference in its entirety.

BACKGROUND OF INVENTION

1. Field of the Invention

Embodiments disclosed herein relate generally to matrix tool bodies such as for drill bits, and more particularly to infiltrated matrix tool bodies and methods for the manufacture of such tool bodies. In particular, embodiments disclosed herein relate generally to use of a highly erosion resistant matrix material located proximate at least a portion of the tool body surface and a higher strength/higher toughness matrix material located inward of the highly erosion resistant matrix material.

2. Background Art

Many different tools used in the oil exploration and production industry utilize bodies or components comprising matrix materials which are exposed to very abrasive and erosive environments. For example, earth boring bits are used in various applications in the earth drilling industry which typically have very abrasive and erosive environments. Earth boring bits have bit bodies which include various features such as a core, blades, cutter pockets that extend into the bit body, and gage pads on a bit body, for example. Depending on the application/formation to be drilled, the appropriate type of drill bit may be selected based on the cutting action type for the bit and its appropriateness for use in the particular formation. In PDC bits, polycrystalline diamond compact (PDC) cutting elements are received within the bit body pockets and are typically bonded to the bit body by brazing to the inner surfaces of the pockets. Bit bodies are typically made either from steel or from a tungsten carbide matrix bonded to a separately formed reinforcing core made of steel.

Matrix bit bodies are typically formed of a single, relatively homogenous composition throughout the bit body. The single composition may contain a single form of hard particles such as a tungsten carbide or a mixture of hard particles such as different forms of tungsten carbide. The matrix material is commonly bonded into solid form by fusing a metallic binder material (binder phase) and the hard particles (hard particle phase, e.g., carbide phase).

The drill bit formation process typically includes placing a matrix powder material within a mold. The mold is commonly formed of graphite and may be machined into various suitable shapes with features that correspond generally with desired exterior features of the resulting matrix drill bit body. Displacements are typically added within the mold to define the cutter pockets. Other formers may also be added to the mold to define other features such as nozzles/ports, internal hydraulic fluid flow passages, external hydraulic fluid flow passages (i.e., junk slots), etc. The matrix powder material may be a powder of a single material such as tungsten carbide, or it may be a mixture of more than one material such as different forms of tungsten carbide. The matrix powder material may include further components such as supplemental metal additives. An infiltrating metal binder material is then typically placed over the matrix powder material. The components within the mold are then heated in a furnace to the flow or infiltration temperature of the binder material at which temperature the melted binder material infiltrates the tungsten carbide or other matrix material. The infiltration process that occurs during sintering (heating) bonds the particles (grains) of matrix material to each other and to the other components to form a solid bit body. The sintering process also causes the matrix material to bond to other structures that it contacts, such as a metallic blank core which may be suspended within the mold to produce the aforementioned reinforcing core. After formation of the bit body, a protruding section of the metallic blank core may be welded to a second component called an upper section. The upper section typically has a tapered portion that is threaded onto a drilling string. The bit body typically includes blades which support the PDC cutting elements which, in turn, perform the cutting operation. The PDC cutting elements are bonded to the body in pockets in the blades, which are cavities formed in the bit for receiving the cutting elements.

The infiltrated matrix materials determine the mechanical properties of the bit body. These mechanical properties include, but are not limited to, transverse rupture strength (TRS), toughness (resistance to impact-type fracture), hardness, wear resistance and/or erosion resistance from rapidly flowing drilling fluid and abrasion from rock formations, steel bond strength between the matrix material and steel reinforcing elements, such as a steel blank, and strength of the bond to the cutting elements, i.e., braze strength, between the finished body material and the PDC cutter.

Typically, a single matrix powder is selected in conjunction with the infiltration binder material, to provide desired mechanical properties to the bit body for ease of manufacturing. The single matrix powder is packed throughout the mold cavity to form a bit body having the same mechanical properties throughout. It would, however, be desirable to optimize the overall structure of the drill bit body by providing different mechanical properties to different portions of the drill bit body, in essence tailoring the bit body. For example, erosion and/or wear resistance is especially desirable at regions proximate the cutting elements and/or throughout the outer surface of the bit body while high strength and toughness are especially desirable in the interior portions of the bit body such as the bit blades and throughout the bulk of the bit body. However, when using a single matrix powder to form the bit body, changing a matrix material to increase erosion and/or wear resistance usually results in a corresponding loss in toughness, or vice-versa.

Further, in packing the matrix powder materials into the mold, the geometry of the bit (and thus mold) make it difficult and time-consuming to place different matrix materials in different regions of a bit body. When using different powdered matrix materials, there is little or no control over powder locations in the mold during assembly, particularly around curved and vertical surfaces. When using a paste of the matrix material and organic binder, it is extremely time-consuming to position the paste by hand in the desired locations to the desired thickness.

Accordingly, there exists a continuing need for developments in matrix tool bodies to improve the erosion and/or wear resistance of the tool body without compromising the strength/toughness of the tool body and without increasing the difficulty of the manufacturing process.

SUMMARY OF THE INVENTION

In one aspect, embodiments disclosed herein relate to methods of manufacturing a matrix tool body. In one or more embodiments, a first matrix material comprising a plurality of hard particles is placed within a first region of a mold cavity proximate a surface of the mold using an adhesive. The plurality of hard particles of the first matrix material have sizes in the range of from 16 mesh to 60 mesh and have a median particle size. A second matrix material comprising a plurality of hard particles is placed within a second region of the mold cavity positioned inwardly of the first matrix material. The plurality of hard particles of the second matrix material have a median particle size that is less than the median particle size of the plurality of hard particles of the first matrix material. The first matrix material and the second matrix material are infiltrated with an infiltration binder to form the tool body. In one or more other embodiments, a wear resistant matrix material comprising a plurality of hard particles having sizes of at least 3000 microns is placed within a first region of a mold cavity proximate a surface of the mold. A second matrix material comprising a plurality of hard particles is placed within a second region of the mold cavity proximate the first region. The plurality of hard particles of the second matrix material have a median particle size that is less than the median particle size of the plurality of hard particles of the wear resistant matrix material. The wear resistant matrix material and the second matrix material are infiltrated with an infiltration binder to form the tool body.

In another aspect, embodiments disclosed herein relate to tool bodies. In one or more embodiments, a first region proximate a surface of the tool body comprises a first matrix material comprising a plurality of hard particles having sizes in the range of from 16 mesh to 60 mesh; a second region proximate the first region which comprises a second matrix material comprising a plurality of hard particles having a median particle size that is less than the median particle size of the plurality of hard particles of the first matrix material; and an infiltrating metal binder present in the first region and the second region. The first region has a thickness in the range of from 250 to 3600 micrometers (microns). In one or more other embodiments, a first region proximate a surface of the tool body comprises a first wear resistant matrix material comprising a plurality of hard particles having sizes of at least 3000 microns; a second region proximate the first region which comprises a second matrix material comprising a plurality of hard particles having a median particle size that is less than the median particle size of the plurality of hard particles of the first wear resistant matrix material; and an infiltrating metal binder present in the first region and the second region.

In yet another aspect, embodiments disclosed herein relate to downhole tools and drill bits incorporating such tool bodies.

DETAILED DESCRIPTION

Figure 1:
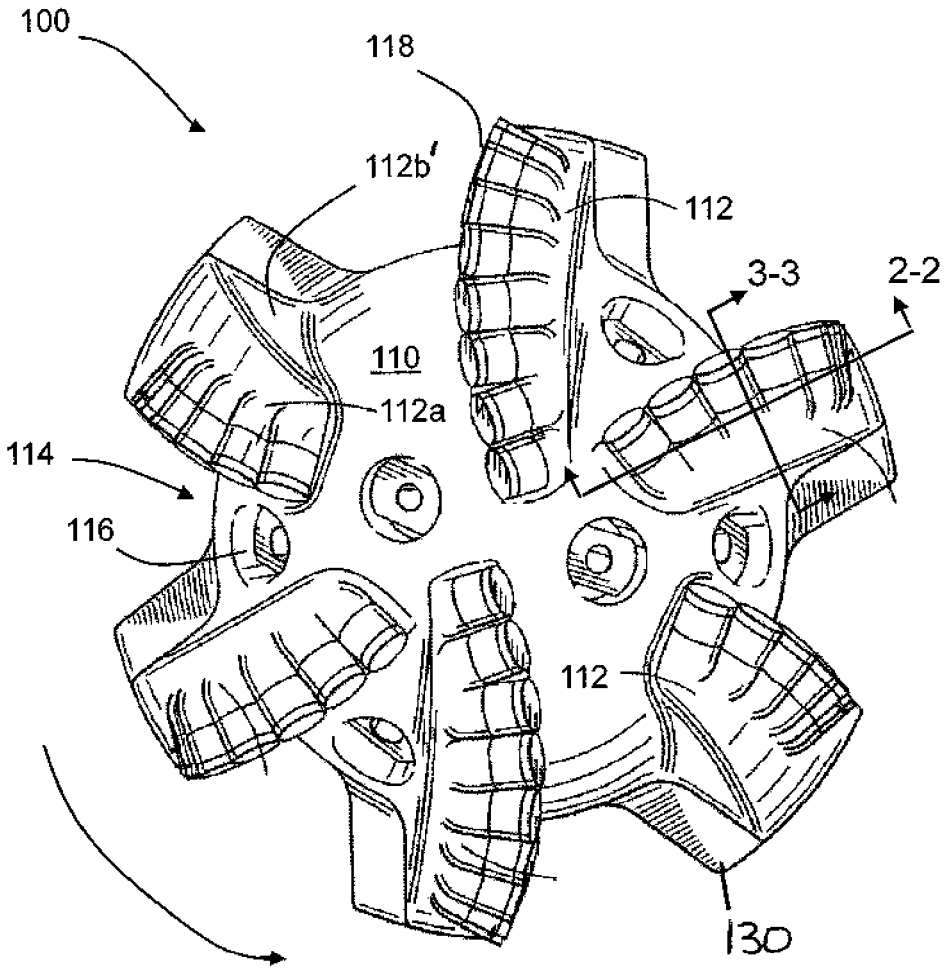
FIG. 1 is a drill bit in accordance with one or more embodiments of the present disclosure.

In one aspect, embodiments disclosed herein relate to tool bodies and the methods of manufacturing and using the same. For example, embodiments disclosed herein relate to PDC drill bits having bit bodies with tailored material compositions which can allow for simplified manufacturing as well as extending their use downhole. Specifically, embodiments disclosed herein relate to PDC drill bit bodies having a relatively thin region of a unique highly erosion resistant first matrix material proximate at least a portion of the surface of the bit body and a region of a softer (tougher and stronger) second matrix material located inwardly of the first matrix material toward the core of the bit body.

The following disclosure is directed to various embodiments of the invention. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in somewhat schematic form and some details of conventional elements may not be shown in the interest of clarity and conciseness.

In the following description and in the claims, the terms "including" and "comprising" are used in an open-ended fashion, and thus, should be interpreted to mean "including, but not limited to . . . "

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

When using the term "different" in reference to materials used, it is to be understood that this includes materials that generally include the same constituents, but may include different proportions of the constituents and/or that may include differently sized constituents, wherein one or both operate to provide a different mechanical and/or thermal property in the material. The use of the terms "different" or "differ", in general, are not meant to include typical variations in manufacturing.

As used herein, the mesh sizes refer to standard U.S. ASTM mesh sizes. The mesh size indicates a wire mesh screen with that number of holes per linear inch, for example a "16 mesh" indicates a wire mesh screen with sixteen holes per linear inch, where the holes are defined by the crisscrossing strands of wire in the mesh. The hole size is determined by the number of meshes per inch and the wire size. When using ranges to describe sizes of particles, the lower mesh size denotes (which may also have a "−" sign in front of the mesh size) the size of particles that are capable of passing through an ASTM standard testing sieve of the smaller mesh size and the greater mesh size denotes (which also may have a "+" sign in front of the mesh size) the size of particles that are incapable of passing through an ASTM standard testing sieve of the larger mesh size. For example, particles having sizes in the range of from 16 to 35 mesh (−16/+35 mesh) means that particles are included in this range which are capable of passing through an ASTM No. 16 U.S.A. standard testing sieve, but incapable of passing through an ASTM No. 35 U.S.A. standard testing sieve.

Referring to FIG. 1, a drill bit in accordance with one embodiment is shown. As shown in FIG. 1, bit 100 includes a bit body 110 including a plurality of blades 112 that extend along the surface of the bit body 110. Blades 112 may extend from proximate a center of the bit body 110 radially outward to the outer diameter of the bit body 110, and then axially downward, to define the diameter (or gage) of the bit 100. Blades 112 terminate at gage pads 130. A plurality of cutting elements 118 are received by cutter pockets (not shown separately) formed in blades 112. The blades 112 are separated by exterior hydraulic fluid flow passages (i.e., junk slots) 114 that enable drilling fluid to flow from nozzles or ports 116 to clean and cool the blades 112 and cutting elements 118.

In a conventional matrix bit, such as formed by infiltrating techniques, a matrix material mixture of hard particles, and optionally supplemental metal binder particles, are poured into the blade portions (and a portion of the interior bit body), a softer, machinable powder is typically poured on top of the matrix material mixture, and the bit is infiltrated with an infiltration binder. Thus, while it might be desirable to have harder or tougher materials in certain areas to prevent premature failure due to the particular condition experienced by that region of the bit body, such as cracking, erosion, etc., because the materials are powders, there is little or no controllability over the resulting placement of the powder materials within a bit. Further, if a paste is used which includes the matrix material mixture and an organic binder, there is a significant increase in the manufacturing time from the added difficulty of positioning the paste in desired locations to the desired thickness. However, in accordance with the present disclosure, a simplified manufacturing process which uses a combination of matrix materials in different regions of the tool body, one of which may be an improved erosion resistant matrix material, results in tool bodies with improved performance. With the simplified manufacturing process of the present disclosure, regions of erosion resistant matrix material may easily be selectively positioned proximate one or more surfaces and softer (tougher/stronger) matrix material may be placed inwardly of the erosion resistant material. The resulting tool body possesses the toughness and strength required to better withstand the impact and fatigue loading experienced during use (such as during drilling an earthen formation) as well as improved erosion resistance to better withstand the degradation caused by the erosive environment experienced during use. Thus, the matrix body of the present disclosure may be advantageously characterized as possessing erosion resistance and/or wear resistance without impairing toughness and strength, and therefore, less susceptible to cracking.

The improved infiltrated erosion resistant matrix material comprises larger than conventionally used hard particles, as discussed herein. It is unexpected that such a matrix material would have an improved erosion resistance as it has been conventional thought that the use of finer hard particle sizes imparts better erosion resistance to an infiltrated matrix material. Additionally, the simplified manufacturing process significantly reduces the man hours associated with conventional hand packing of multiple matrix powders or a combination of matrix material paste and powder.

Examples of such regions which may be formed of such erosion resistant matrix materials include any region which may benefit from improved erosion resistance including one or more portions proximate the outer surface of the bit or surrounding any bit components, including blade tops (upper surface of the blade) (e.g., behind the cutting elements and/or between the cutting elements positioned along the leading edge of the blade), blade sidewalls (e.g., leading side and trailing side), gage pad tops (upper surface of the gage pad), gage pad leading sides, gage pad trailing sides, regions surrounding nozzles or ports, regions proximate cutting elements (cutter pockets), and any other bit body exterior surfaces. However, there is no limitation on the number of regions of the bit body which may be formed of such erosion resistant materials.

Figure 2:
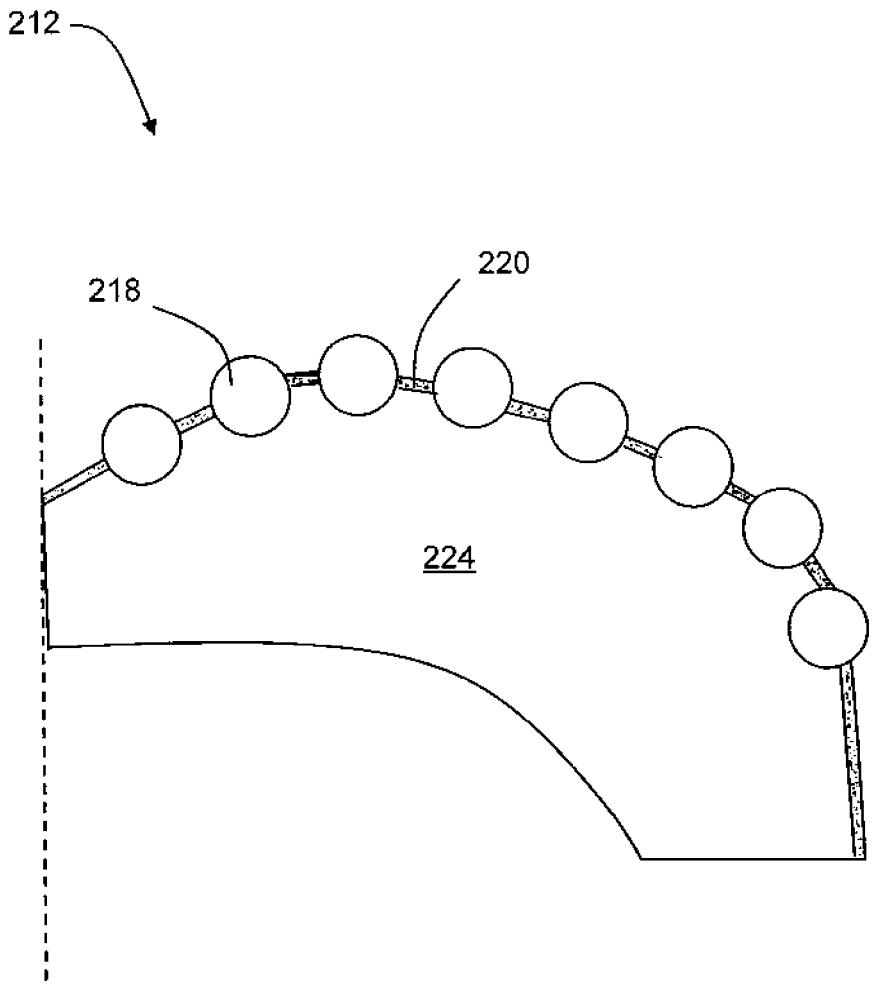
FIG. 2 shows a cross-sectional view of a blade along 2-2 of the bit of FIG. 1.

For example, as shown in FIG. 2, the upper surface of blade 212 (or blade top 112*a* shown in FIG. 1) may form a first matrix region 220 containing the erosion resistant matrix material, described herein (which interposes cutting elements 218 as shown in this cross-sectional view along 2-2), whereas the inner region 224 of the blade 212 forms a second matrix region 224 containing a tougher and/or stronger matrix material which has a lower median particle size compared to the erosion resistant matrix material of the first matrix region 220. While toughness and strength are desirable for durability, an erosion resistant exterior is desirable to prevent premature deterioration of the bit body material, especially on the upper surface of the blades.

Figure 3A:
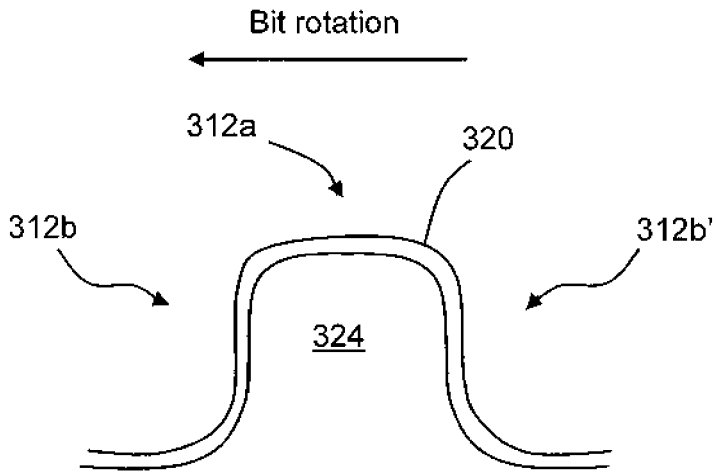
FIGS. 3A-3D show cross-sectional views of various embodiments of a blade along 3-3 of the bit of FIG. 1.
Figure 3B:
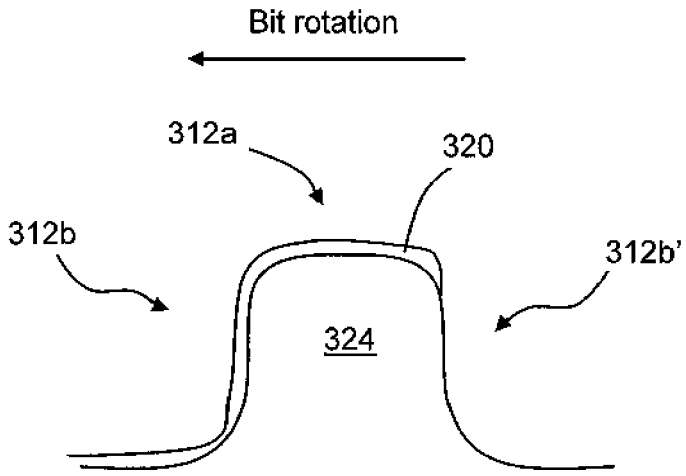
Figure 3C:
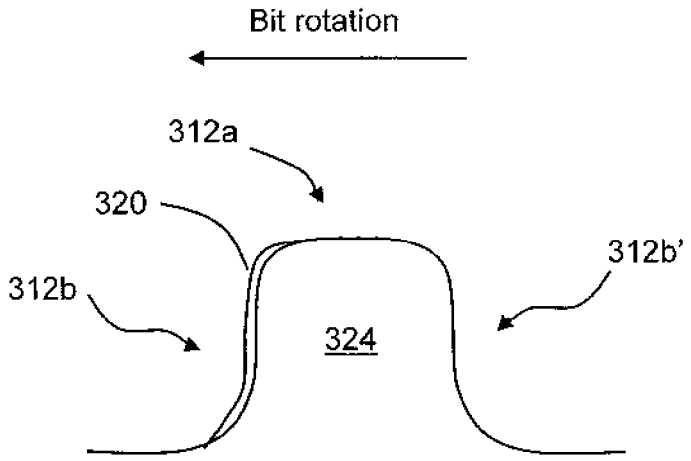
Figure 3D:
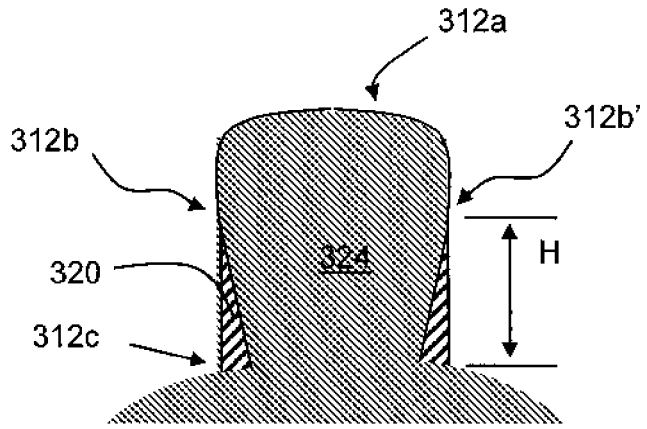

In addition to a first matrix region being along a blade top (112*a* in FIG. 1), as shown in FIGS. 3A-D (taken in cross-sectional view of the blade along 3-3), various embodiments may provide for first matrix region 320 containing the erosion resistant matrix material to be placed on at least a portion of blade tops (112*a* in FIG. 1) and/or blade sidewalls (112*b*' in FIG. 1). Specifically, as shown in FIG. 3A, first matrix region 320 may occupy blade top 312*a* and both the leading 312*b* and trailing 312*b*' sidewalls, which are determined by the direction in which the bit rotates downhole. One skilled in the art would appreciate that a leading edge 312*b* or sidewall is the edge of the blade which faces the direction of rotation of the bit, whereas the trailing edge 312*b*' is the edge of the blade that does not face the direction of rotation of the bit. One skilled in the art would appreciate that this description with respect to leading and trailing sides would also apply to the gage pads. Within the inner region of the blade, for example, adjacent an inner periphery of first matrix region 320 is second matrix region 324. Second matrix region 324 contains a tougher and/or stronger matrix material which has a lower (lesser) median particle size compared to the erosion resistant matrix material of the first matrix region 320. Other variations may also be within the scope of the present disclosure. For example, as shown in FIG. 3B, first matrix region 320 forms blade top 312*a* and leading blade sidewall 312*b*, but second matrix region 324 forms the inner core and trailing sidewall 312*b*' of blade 312. Further, as shown in FIG. 3C, only leading sidewall 312*b* is formed of first matrix region 320, and blade top and 312*a* and trailing sidewall 312*b*' is formed of second matrix region 324. Additionally, first matrix region forming a blade sidewall need not extend the entire height of a blade. As shown in FIG. 3D, first matrix region extends a selected height H from a base of blade 312*c* (where blade 312 extends from the surface of the bit body (not shown separately)) along the leading and trailing sidewalls 312*b*, 312*b*'.

The effect of such embodiments is a more erosion resistant exterior on a tougher supporting material. The interior tougher supporting material (making up a major portion of the total matrix material utilized to form the bit) may also be less expensive than the exterior erosion resistant material. U.S. Patent Application Publication No. 2008/0164070A1, which is assigned to the present assignee, describes a hardfacing material applied to a matrix bit body. However, unlike a hardfacing, the first matrix region having the greater erosion resistance is intergrally formed with the remainder of the bit body, sharing common binder material, and thus metallurgically bonding the materials. This can provide for less crack formation in the first matrix region as compared to a hardfacing layer applied to a solid surface. Hardfacing applied by conventional welding techniques tends to have multiple cracks even before drilling commences. Further, as discussed below in greater detail, the methods and materials may also allow for a simplified manufacturing process while providing an improved matrix tool body.

Additionally, while only a single outer matrix region and inner matrix region is shown in some of these embodiments, it is also within the scope of the present disclosure that multiple gradient layers of matrix materials may be used. Thus, for example, one or more additional regions may be formed between the first (outer) matrix region and the second (inner) matrix region to transition from harder more erosion resistant materials to tougher materials to minimize issues concerning differences in coefficient of thermal expansion properties, strength and integrity as well as formation of stresses within the bit body.

Figure 4:
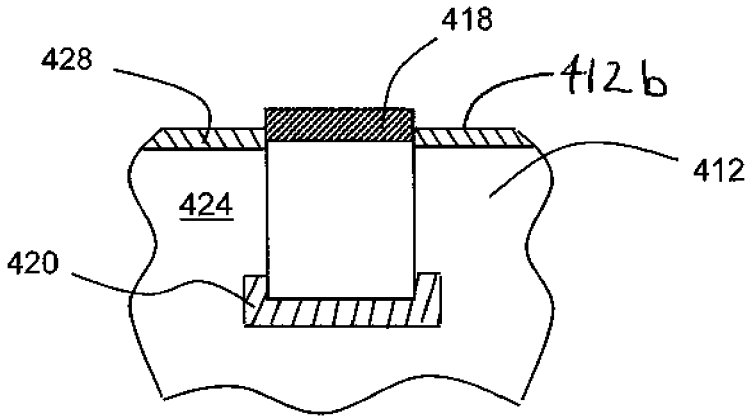
FIG. 4 shows a cross-sectional view of a blade through a cutter in accordance with one or more embodiments of the present disclosure.

In another embodiment, multiple matrix regions may be used so that at least a portion of the area surrounding cutting elements may be independently selected for desirable material properties. For example, as shown in FIG. 4, first matrix region 428 (containing the erosion resistant matrix material) forms at least an outer surface of blade 412, on leading blade sidewall 412*b* as discussed in FIGS. 3A-D, while a third matrix region 420 (formed of a relatively tough material, for example, the material may have a greater toughness and/or braze strength than other regions of blade 412) supports base of cutter 418, the remainder of blade 412 being formed of second matrix region 424. Thus, it is clear that by using the materials and methods of the present disclosure, bits having various regions formed of materials specific to the needs of the particular regions may be obtained.

Figure 5:
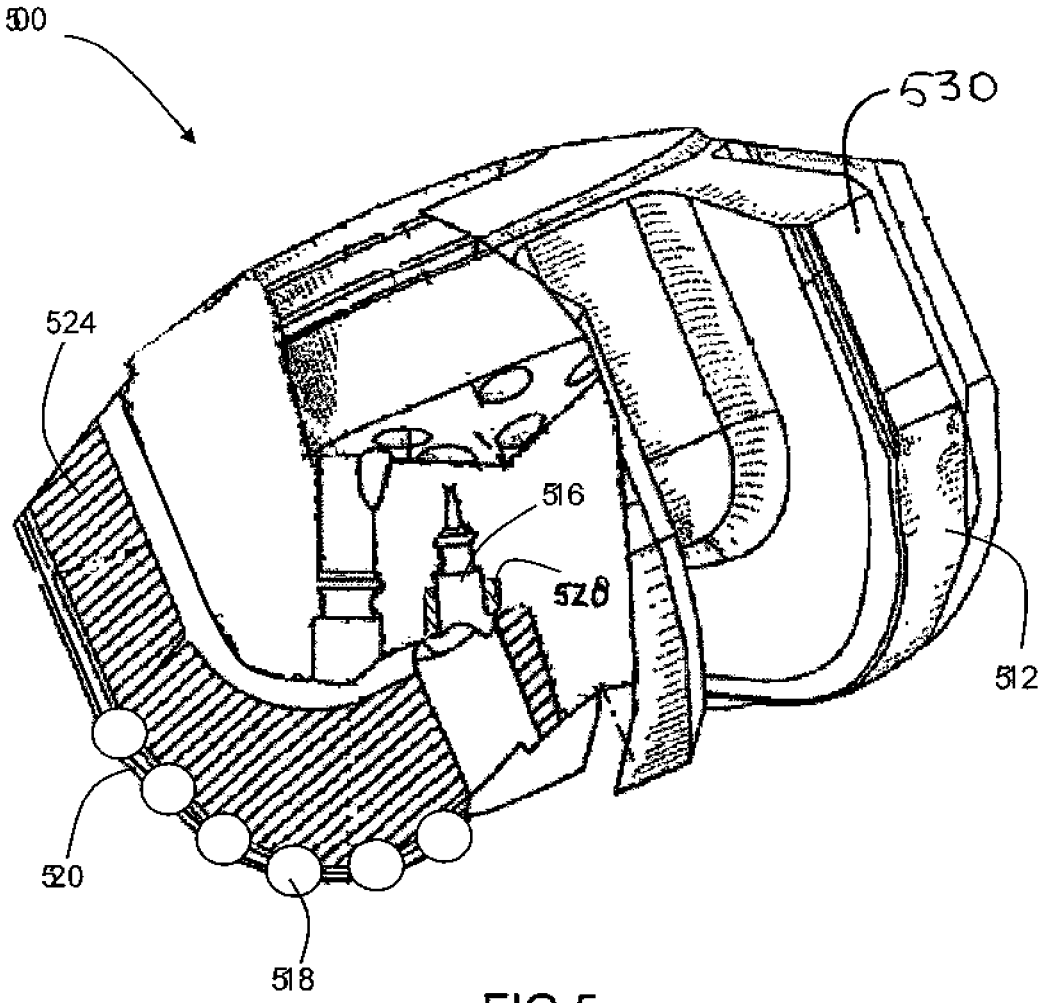
FIG. 5 shows a partial section view of a bit body in accordance with one or more embodiments of the present disclosure.

Turning now to FIG. 5, yet another embodiment is shown. As shown in FIG. 5, a cutaway view of a bit 500 is shown. Bit 500 includes matrix bit body having blades 512 extending along the cutting face, cutting elements 518 disposed on blades 512, and gage pads 530 disposed axially downward from blades 512. Further, a first matrix region 520 forms an exterior surface of blades 512, with the inner portion of blades 512 being formed from second matrix region 524. Additionally, nozzles/ports 516 extend through bit body to allow the flow of drilling fluid therethrough. As shown in FIG. 5, at least a portion of the area surrounding nozzles/ports 516 may be formed of an additional matrix region 528. Because exterior surfaces and nozzle area typically encounter greater erosion, first matrix regions 520 may be provided with the erosion resistant material, as described herein, and the remaining portions of the bit body, including second matrix region 524, may be provided with one or more matrix materials having one or more different properties as described herein.

Thus, embodiments of the present disclosure provide a matrix tool body having various portions of the body formed of a unique erosion resistant material, as compared to neighboring (adjacent) regions of the body. Further, in one or more embodiments, the first matrix region and the second matrix region may be formed of materials which result in a bulk hardness difference of at least 7 HRC and up to 50 HRC.

Suitably, in one or more embodiments, the first matrix region may have an increased erosion resistance by at least 20% over the second matrix region interior to the first region, for example at least 30%, at least 50%, at least 75%, at least 100%, at least 200%, at least 300%, at least 400%, at least 500%, or at least 600%. Without wishing to be bound to any particular theory, it is believed the coarser particles in the first matrix region can provide for an "anchoring effect" in the infiltrated matrix material of the first region, thus, improving the erosion resistance of the material.

Suitably, in one or more embodiments, a majority (more than 50% w) of the hard particles contained the first matrix region have a microhardness (e.g., Vickers microhardness) difference of at least 500 kg/mm$^2$ ($HV_{0.3kg}$) compared to the hard particles contained in the second matrix region, for example at least 1000 kg/mm$^2$ or at least 1500 kg/mm$^2$. Suitably, at least 75% w of the hard particles contained in the first region may have such microhardness differences, for example at least 85% w or at least 95% w.

To achieve such difference, combinations of materials (and thus material properties) may be used in forming the bits of the present disclosure. The bits of the present disclosure have curved surfaces thereof or vertically oriented portions thereof which may be tailored with an erosion resistant matrix material composition (as discussed herein) depending on the particular region of the bit body. It is specifically within the scope of the present disclosure that materials may be selected for the various regions of the bit to provide a differential in erosion resistance/toughness, etc, depending on the loads and potential failure modes frequently experienced by that region of the bit. For example, in a particular embodiment, a base or inner region of a blade may be formed of a less erosion resistant or tougher material than the top of the blade so as to provide greater support and durability to the blade, and reduce or prevent the incidents of blade breakage, while also achieving necessary erosion and/or wear resistance to the selected exterior surfaces.

Manufacturing of a tool body, for example a drill bit body, in accordance with the present disclosure may begin with the fabrication of a mold, having the desired body shape and component configuration, including blade geometry. Using conventional powder metallurgy, creating a curved or vertical surface region from a separate powder material (as compared to neighboring regions of the bit body) can be difficult. However, in accordance with embodiments of the present disclosure, the erosion resistant matrix material (as described herein) may be placed in the desired location of the mold, corresponding to the regions of the bit body desired to have the erosion resistant material properties. The other regions or portions of the bit body may be subsequently filled with one or more different matrix materials. Such different matrix materials may have greater toughness and/or strength and may have a lower median particle size than the erosion resistant matrix material. The erosion resistant regions may be formed using a single application of adhesive and erosion resistant matrix material to the mold cavity or with multiple applications. The mold contents may subsequently be infiltrated with a molten infiltrating metal binder and cooled to form a bit body. In embodiments where one or more unique matrix materials are used to surround any portion of a cutter, it is also within the scope of the present disclosure, that such materials may be affixed to a displacement (used in the art to hold the place of cutting elements during bit manufacturing, i.e., used to form the cutter pocket) prior to or subsequent to placement of the displacement in the mold. In a particular embodiment, during infiltration, finer matrix material hard particles loaded within the mold may be carried down with the molten infiltrant to fill any gaps between the hard particles.

In one or more embodiments, a mold preparatory coating may be applied to at least a portion of the surface of the mold prior to application of an adhesive. After the preparatory coating dries, an adhesive may be applied thereon. The preparatory coating may be any coating capable of reducing reactions between the mold material and the matrix material during infiltration (e.g., reducing the reaction between a graphite mold and any cast carbide present in the matrix material) and/or capable of releasing the matrix material from the mold surface without damaging the matrix material after infiltration. For example, a mold preparatory coating may comprise a boron nitride coating.

The erosion resistant matrix material may be affixed within the mold cavity using an adhesive. In one or more embodiments, an adhesive may be applied to the surfaces within the mold cavity corresponding to the areas where erosion resistant regions may be desired. The surfaces may include the surfaces of the mold and/or one or more formers or displacements within the mold cavity. The formers may be used for the nozzles/ports, for the internal hydraulic fluid flow passages, for the external hydraulic fluid flow passages (i.e., junk slots), etc. Thus, the surfaces may include curved and vertical surfaces located within the mold cavity.

In one or more embodiments, the erosion resistant matrix material may be affixed onto an organic-based medium using an adhesive and the medium may subsequently be affixed within the mold cavity. Such organic-based medium may be any medium capable of vaporizing during infiltration, for example paper, polymeric films, graphite tape, etc. An advantage of this embodiment is that a bit designer may print a predetermined pattern for a particular region of the bit surface and the manufacturing operator could then affix the erosion resistant matrix material to the pattern and then place within the mold cavity in the corresponding region where the erosion resistant material is desired. This can allow for more intricate arrangements of the erosion resistant materials while simplifying the manufacturing process.

The surfaces where the erosion resistant matrix material may be used may include the blades, managed depth of cut features, cutter pockets, nozzle/ports, gage pads, external and internal hydraulic fluid passageways, the reaming blades of a bi-center bit, the transition area of a bi-center bit between the pilot blades and the reaming blades, and combinations thereof.

The adhesive may be applied using an applicator, such as a brush or sponge, and/or using a sprayer, such as an air sprayer or an airless sprayer, and/or an adhesive tape, such as double-sided tape and/or a tool with a tapered end for placing into restricted areas such as corners and spaces between displacements which form the cutter pockets. Sufficient erosion resistant matrix material (in powder form) may then be introduced into the mold cavity. The mold may then be rotated or tumbled to evenly distribute the erosion resistant matrix material. The excess erosion resistant matrix material may then be removed (e.g., poured) from the mold cavity and the remaining material allowed to dry or cure.

In one or more embodiments, the erosion resistant matrix material may be mixed with an adhesive and sprayed onto the desired mold surfaces using an air or an airless sprayer. Alternatively, the adhesive and erosion resistant matrix material particles (powder) may flow from separate nozzles but be mixed in stream prior to contacting the surface of the mold. A mixture of the erosion resistant matrix material may also be mixed with an adhesive and spread onto the desired mold surfaces.

In one or more embodiments, hook-and-loop fasteners may be utilized to affix the erosion resistant matrix material to a surface of the mold cavity. Any suitable hook-and-loop fastener may be used, for example a VELCRO fastener. Either the hook side or the loop side of the fastener may be affixed to a surface within the mold cavity using an adhesive, as discussed above. The erosion resistant matrix material may then be placed within the hooks or loops attached to a fabric such as nylon, polyester, etc. which hooks or loops may be of a suitable size and concentration to mechanically hold the erosion resistant matrix material to the surface of the mold cavity.

Alternatively, or in addition, other methods may be used including the use of magnetic forces and/or static electricity to place the matrix materials along the surfaces of the mold cavity. For example, a strong magnet such as a magnetic block, ring or collar may be placed along an exterior surface of the mold. For example, static electricity may be generated along interior surfaces of the mold cavity.

In one or more embodiments, clusters of erosion resistant matrix material may be formed by mixing the erosion resistant matrix material with a suitable organic material capable of forming clusters of erosion resistant matrix material, for example an adhesive as discussed herein or a wax material. The suitable cluster-forming material should have an adhesion strength sufficient to hold the erosion resistant matrix material particles together during loading of the mold but not so great an adhesion strength that the particles cannot break apart during infiltration. This can result in a greater average mean free path between hard particles in the erosion resistant region, providing a matrix material with greater resistance to crack formation and/or crack propagation.

The mean free path represents the mean distance between hard particles (e.g., metal carbide). One skilled in the art should appreciate after learning the teachings related to the present disclosure that the total range of hard particle to hard particle distances may vary; however, an average mean free path may reflect the general distribution of hard particles in the matrix material. Using this metric, the greater the mean free path (for a given hard particle concentration) the more evenly distributed the hard particles are. Suitably, the average mean free path between hard particles in the infiltrated erosion resistant first region may be at least 5 microns, for example at least 15 microns, greater than 30 microns, greater than 35 microns, greater than 40 microns, greater than 45 microns, or greater than 50 microns. One skilled in the art should appreciate after learning the teachings related to the present disclosure that the mean free path may depend, to some extent, on the volume of hard particles in the matrix material. Thus, such average mean free path values listed above may reflect the mean free path of hard particles where the content of hard particles is in the range of from 45 to 65 percent by volume (% v) of the total erosion resistant matrix material.

Figure 6:
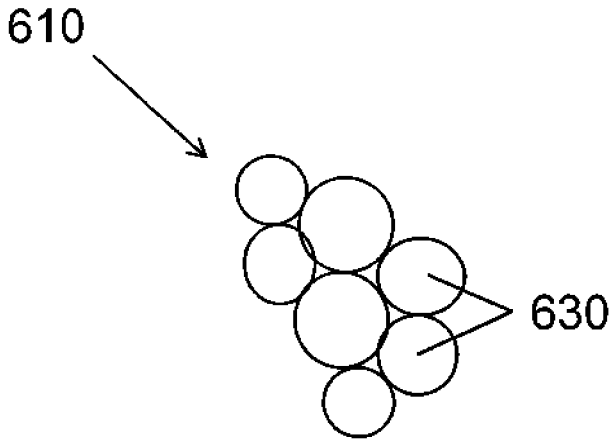
FIG. 6 illustrates a cluster of erosion resistant material in accordance with one or more embodiments of the present disclosure.

FIG. 6 illustrates a cluster 610 of erosion resistant material comprising hard particles 630. Although not shown, it is also understood that the erosion resistant matrix material may also contain one or more supplemental metal binders which may also be incorporated into the clusters. Such clusters may have a particle size ranging from 750 micrometers to 6500 micrometers (particle size for the finished cluster), for example 1000 micrometers, 1200 micrometers, 1500 micrometers, 2000 micrometers, 2500 micrometers, 3000 micrometers, 3500 micrometers, 4000 micrometers, 4500 micrometers, 5000 micrometers, or 5500 micrometers. The clusters may be formed by mixing the erosion resistant matrix material with the organic material; manually forming the mixture into clusters; and subjecting the clusters to sufficient conditions to dry or cure the clusters forming the finished product. The clusters may also be formed by mixing the erosion resistant matrix material with the organic material; utilizing an agglomeration machine, such as Dr. Fritsch Granulating Machine GA 240, to form the clusters. In using such machine, the mixture of erosion resistant matrix material may be placed on a rotating steel pan operated under suitable conditions to form clusters of a desired size, and subsequently drying/curing the clusters forming the finished product. The clusters may be placed along a desired surface of the mold using any technique. The clusters may be placed into the mold without the use of any additional materials, such as an adhesive, since they can interlock with each other preventing movement during vibration of the mold. In other embodiments, the clusters may be placed into the mold using an adhesive, as discussed above. In still other embodiments, the clusters may be incorporated into a moldable material such as a paste or clay-like material and placed along a desired surface of the mold. The clusters may be used at any location suitable for using the erosion resistant material. In an embodiment, the clusters may be placed proximate the nozzles/ports, especially along the exterior surfaces of the tool (e.g., bit) where the velocity of the drilling fluid contacting the bit surface is greatest. For example, such areas may also include the areas proximate the cutting elements as drilling fluid may be directed toward the cutting elements for cleaning purposes. One skilled in the art should appreciate after learning the teachings related to the present disclosure that these areas may be provided with any suitable erosion resistant material.

The adhesive may be any organic-based material capable of securing (affixing) the erosion resistant matrix material particles to a surface of the mold cavity after drying or curing and which vaporizes during heat processing. After infiltration, the hard particles (hard particle phase, e.g., carbide phase) will become secured in the metal binder phase (infiltrant metal binder and optionally supplemental metal binder), thus, forming the tool body. The adhesive may be selected from one or more adhesives such as a rubber-based adhesive, an epoxy adhesive, a silicon adhesive, an acrylic adhesive, an acrylate adhesive, a polyurethane adhesive, and a polyvinyl acetate adhesive. Suitably, the adhesive may dry/cure such that the interstitial spaces between particles are substantially empty. By substantially empty, it is meant that at least 80% of the volume between hard particles is void of any solid material, suitably at least 90% v, more suitably at least 95% v. The adhesive may be water-based or solvent-based. Acrylate adhesives may include polyacrylates or alkyl-2-cyanocrylates, e.g., methyl 2-cyanoacrylate, ethyl-2-cyanoacrylate. Products such as LOCTITE SUPERGLUE adhesive products, LIQUID NAILS adhesive products such as BL-70 latex adhesive for reinforced vinyl and asphalt tile, Dr. Fritsch GB-600 high strength glue, and Rubber cement, may be used as the adhesive. The adhesive may be chosen based on the desired drying times and temperatures for the adhesive. In one or more embodiments, the adhesive may still be pliable (not completely dry) after at least 1 minute, for example at least 5 minutes, at least 15 minutes, at least 30 minutes, or at least 60 minutes. In this embodiment, the adhesive may not be completely dry before the addition of the second matrix material or before subjecting the mold contents to temperatures sufficient to infiltrate the matrix materials with the infiltrating metal binder.

The thickness of the layer (region) of erosion resistant matrix material particles in the one or more relatively thin first matrix regions prior to infiltration may suitably be in the range of from 1 to 5 hard particles thick (hard particles of the first matrix material), suitably 1 to 3 hard particles thick, suitably 1 to 2 particles thick. The thickness of the layer of erosion resistant matrix material particles may be in the range of from 250 microns to 6500 microns, suitably from 275 microns to 4000 microns, more suitably from 300 microns to 3600 microns, most suitably from 350 microns to 2400 microns, for example from 400 microns to 1500 microns, for example about 1000 microns in thickness. Desired thickness may be based in part on the size of the hard particles being used.

After applying the erosion resistant matrix material particles to at least a portion of the surfaces, a steel blank core may be placed into the mold cavity. Other formers and displacements may be positioned in the mold cavity prior to or after the steel blank core. If one or more formers are to have the erosion resistant matrix material applied thereto, it may be advantageous to mount the formers into the mold cavity prior to the steel blank core so the adhesive and particles may be applied in one process. At least a portion of the surfaces of one or more displacements, and optionally one or more formers, may have one or more different additional matrix materials positioned adjacent a surface thereof which have one or more different properties from the adjacent matrix materials. The regions of different additional matrix materials may be applied using dividers (made of plastic or metal) to segregate the different matrix material powder from adjacent matrix materials; an adhesive, a paste-like or moldable material (as described in U.S. patent application Ser. No. 12/121,575, filed on May 15, 2008, which is assigned to the present assignee and herein incorporated by reference). After placement of the steel blank core, the mold cavity may then be filled with one or more matrix materials such as the second matrix material. A remaining portion of the mold may be filled with a machinable powder such as a tungsten powder.

Suitably, the mold may be vibrated at this point of the process to ensure that the powdered matrix material particles are completely packed such that all voids have been filled. During vibration of the mold, the finer hard particles contained in the interior matrix materials may migrate between the hard particles of the first erosion resistant matrix material, filling the interstitial spaces between the hard particles affixed to the surfaces within the mold cavity. Thus, a relatively thin erosion resistant region may be formed proximate one or more surfaces of a tool body which region has a high volume fraction of hard particles. This is advantageous compared to using paste-like materials containing organic binders to adhere the matrix material to a surface because the organic binders severely limit the movement of finer particles into the interstitial spaces between larger particles. An additional advantage of this process compared to using paste-like materials or powders is that it is a greatly simplified manufacturing process which still allows for precision/controllability in the placement and thickness of the improved erosion resistant first matrix region.

Infiltrant binder material may then be placed on top of the powder to fill the mold. The amount of infiltrant binder material may be at least slightly in excess of the amount to completely fill all of the interstitial spaces between matrix material particles. The mold may then be placed in a furnace which is heated to above the melting point of the infiltrant binder material as well as any additional metal binder additives contained within the matrix materials, discussed hereinafter. Typically, the temperatures range from about 900° C. to 1375° C., suitably from 1000° C. to 1250° C., for example about 1200° C. The molten infiltrant binder material travels through the mold cavity and infiltrates the interior matrix materials as well as the first erosion resistant matrix material placed along the surfaces. After cooling, the body is removed from the mold and a portion may be machined off. The result is a solid body which is bonded to the steel blank core. A protruding section of the metallic blank core may be welded to a second component called an upper section. The upper section typically has a tapered portion that is threaded onto a drilling string. Alternatively, the metallic blank core may have a threaded connection, such as an American Petroleum Institute (API) connection, formed thereon. Cutting elements may be secured within the mold or may be mounted (e.g., brazed) after the body has been removed from the mold.

The infiltrating metal binder material may include all transition metals, main group metals and alloys thereof. Suitably, copper, nickel, iron, and cobalt may be used as the major constituents in the infiltration metal binder. Other elements, such as aluminum, manganese, chromium, zinc, tin, silicon, silver, boron, and lead, may also be present in the infiltration binder. Examples may include a Cu—Mn—Ni—Zn alloy, Cu—Mn—Ni—Zn—Sn alloy, Cu—Mn—Ni—Sn—Zn—Fe alloy, Cu—Mn—Ni—Zn—Fe—Si—B—Pb—Sn alloy, Cu—Mn—Ni alloy, Ni—Cr—Si—B—Al—C alloy, Ni—Al alloy, Cu—P alloy, Co-alloy, Fe-alloy, and Cu-alloy. The infiltrating metal binder may be a heat treatable metal binder, i.e., the properties of the matrix material improve after a subsequent heat treatment following infiltration.

An example of an infiltrating metal binder is described in U.S. Pat. No. 5,662,183, which description is incorporated by reference herein, and which describes an infiltrating metal binder comprising a metal selected from cobalt, iron, and nickel, for example an alloy which has a composition of nickel (60 to 81% w) alloyed with 8 to 12% w cobalt, 5 to 10% w chromium, up to 3% w aluminum and about 1% w boron. The alloy may additionally contain up to 5% w silicon, up to 5% w carbon, and trace amounts of manganese, and iron. The binder may also contain up to 25% w refractory metal comprising titanium, zirconium, hafnium, vanadium, niobium, tantalum, chromium, molybdenum, tungsten and combinations thereof.

Another example of an infiltrating metal binder is described in U.S. Pat. Nos. 6,461,401 and 6,375,706, which descriptions are incorporated by reference herein, and which describe an infiltrating metal binder alloy comprising copper in the range of from 24 to 96% w (e.g., 57% w), nickel in the range of from 0 to 15% w (e.g., 10% w), manganese in the range of from 0 to 25% w (e.g., 23% w), zinc in the range of from 3 to 20% w (e.g., 4% w), and tin in the range of from more than 1% w to 10% w (e.g., 6% w). Additionally, cobalt may also be substituted for a portion of the copper, for example in the range of 0 to 6% w (e.g., 2 to 3% w).

In some embodiments, one or more additional applications of adhesive and different additional matrix materials may be applied to the first matrix material region(s) to create a gradient in one or more properties between the erosion resistant matrix material and the matrix material forming a substantial portion of the interior of the tool body. Substantial portion is meant to include the matrix material present in the greatest amount within the tool body. The gradient may provide for better bonding of the first erosion resistant matrix region(s) to the interior matrix material.

The matrix materials contain hard particles. The hard particles may have a Vickers hardness of at least 500 kg/mm$^2$, suitably at least 1000 kg/mm$^2$, for example 1200 kg/mm$^2$, 1500 kg/mm$^2$, 1700 kg/mm$^2$, 1800 kg/mm$^2$, 1900 kg/mm$^2$, 2000 kg/mm$^2$, 2200 kg/mm$^2$, 2300 kg/mm$^2$, 2500 kg/mm$^2$, 2700 kg/mm$^2$, 2900 kg/mm$^2$, 3000 kg/mm$^2$, 3200 kg/mm$^2$, 3400 kg/mm$^2$, 3500 kg/mm$^2$, 3700 kg/mm$^2$, 3900 kg/mm$^2$, or 4000 kg/mm$^2$ ($HV_{0.3kg}$—Vickers hardness with a 0.3 kg load). The hard particles may be selected from one or more of macrocrystalline tungsten carbide particles, carburized tungsten carbide particles, cast tungsten carbide particles, and sintered tungsten carbide particles. Additionally, non-tungsten metal carbides of molybdenum, vanadium, chromium, titanium, tantalum, niobium, and other carbides of the transition metal group may be used as hard particles. Carbides, oxides, and nitrides of Group IVA, VA, or VIA metals may also be used as hard particles. The matrix hard particles may have a broad or narrow and mono, bi- or otherwise multimodal distribution. The hard particles may be in the form of non-spherical particles (i.e., crushed/angular particles) or spherical particles (i.e., pellets). The term "spherical", as used herein and throughout the present disclosure, means any particle having a generally spherical shape and may not be true spheres, but lack the corners, sharp edges, and angular projections commonly found in crushed/non-spherical particles. The term, "non-spherical", as used herein in the present disclosure, means any particle having corners, sharp edges and angular projections commonly found in crushed/non-spherical particles.

The matrix materials may contain one or more supplemental metal binders. The supplemental metal binder may include all transition metals, main group metals and alloys thereof. Suitably, copper, nickel, iron, and cobalt may be used may be used as the major constituents in the supplemental metal binder. Other elements, such as aluminum, manganese, chromium, molybdenum, titanium, niobium, zinc, tin, silicon, silver, boron, and lead, may also be present in the supplemental metal binder. The supplemental metal binder may be a heat treatable metal binder, i.e., the properties of the matrix material improve after a subsequent heat treatment following infiltration. In some example embodiments, a matrix material used to form at least a portion of the tool body may contain a supplemental metal binder different from the infiltrating metal binder material, in particular a powder metal binder having a lower melting temperature than the infiltrating metal binder. Suitable supplemental metal powder binders may include, for example, Cu, Co, Ni, and Cu—Mn, Cu—P, Cu—Sn, Cu—Zn, Cu—Ag, Ni—Cr—Si—B alloys, super alloys (such as Ni-based, Co-based, and Fe—Ni-based super alloys), and combinations thereof. Suitably, the supplemental metal binder may comprise nickel (Ni). Additionally, different supplemental powder metal binders may be used for different regions of the tool body.

Suitably, the quantity of supplemental metal binders may be in the range of from 2 to 16% w, based on the weight of the matrix material (powder, before infiltration), more suitably from 2 to 10% w, for example from 4 to 8% w, same basis. Further, it may also be desirable for those metals to be alloys having low coefficient of thermal expansion, i.e., a coefficient of thermal expansion more similar to that of tungsten carbide. Specifically, cracks occur in a bit body during the heating up/cooling down due to high residual stress from thermal expansion mismatch of dissimilar materials. Therefore, use of an alloy having a lower coefficient of thermal expansion may provide for means to use particles that might otherwise be more crack-susceptible in a crack prone area (such as adjacent the cutter pocket). Such alloys may include, for example, cobalt, nickel, iron, tungsten, molybdenum, titanium, tantalum, vanadium, and/or niobium alloyed with each other or along with carbon, boron, chromium, and/or manganese, such as iron-nickel-cobalt alloys, nickel-iron alloys, as well as other glass-to-metal sealing alloys. Two commercial examples of such powder materials include those sold under the trade names INVAR™ and SEALVAR™, which are available from Ametek® Specialty Metal Products (Wallingford, Conn.). Such types of metals may be described in more detail in U.S. patent application Ser. No. 09/494,877, which is assigned to the present assignee and herein incorporated by reference in its entirety. In a particular embodiment, the metal may have a thermal expansion coefficient of less than 10 ppm/° C. within temperature ranges of 100 to 700° C., or less than 6 ppm/° C. in more particular embodiments. Further, in another particular embodiment, the metal may have a thermal expansion coefficient difference with the carbide particles of less than 5 ppm/° C. and less than 2 ppm/° C. in a more particular embodiment. WC has a thermal expansion coefficient of ~5.2 ppm/° C., but the precise metal (with its given thermal expansion coefficient) would be based on the particular type of carbide used. Alternatively, the metal may also be a heat-treatable metal alloy, including a precipitation hardening alloy.

One of ordinary skill in the art should appreciate after learning the teachings related to the present disclosure that two or more supplemental powder metal binders may be used in different regions depending on the application.

The matrix materials may contain one or more ultra hard particles. The ultrahard particles (or grit) may be selected from polycrystalline diamond, thermally stable polycrystalline diamond, polycrystalline boron nitride, thermally stable polycrystalline boron nitride, and combinations thereof. As used herein, the term "thermally stable" or "TSP" is understood to refer to a thermally stable polycrystalline material having a microstructure characterized by: 1) a region within a polycrystalline phase comprising bonded-together ultra hard particles, such as polycrystalline diamond, and a plurality of voids or substantially empty pores in the polycrystalline phase; or 2) a polycrystalline phase comprising ultra hard particles and a second phase interspersed within the polycrystalline phase containing a material with a coefficient of thermal expansion more closely matching the ultra hard particles than the catalyst material used to form the polycrystalline phase. The second phase material may be in the form of a reaction product with the ultra hard particles after high pressure/high temperature processing. In an example embodiment, the reaction product may be formed by reacting a non-solvent catalyst material known to form a relatively stable compound with the polycrystalline phase.

The erosion resistant matrix material comprises a plurality of hard particles, as described herein, having sizes in the range of from 16 to 60 mesh (−16/+60 mesh) (about 250 microns to about 1200 microns), suitably in the range of from 20 to 50 mesh (−20/+50 mesh) (about 300 microns to about 850 microns), more suitably in the range of from 35 to 45 mesh (−35/+45 mesh) (about 350 microns to about 500 microns). Suitably, at least 50 percent by weight (% w) of the hard particles of the erosion resistant matrix powder material may be within these particles sizes, more preferably at least 75% w, most preferably at least 95% w. Suitably, at least a portion of the hard particles of the erosion resistant matrix material may be spherical in shape, for example substantially all the hard particles of the erosion resistant matrix material may be spherical in shape. Suitably, at least a portion of the hard particles of the erosion resistant matrix material may be non-spherical in shape, for example substantially all the hard particles of the erosion resistant matrix material may be non-spherical in shape. Suitably, the hard particles of the erosion resistant matrix material may contain a mixture of spherical and non-spherical particles. A mixture of spherical and non-spherical hard particles may be advantageous in that better packing of the hard particles may be achieved during application to the surfaces within the mold cavity.

Suitably, the hard particles of the erosion resistant matrix material may comprise a metal carbide, as described herein. Preferably, the metal carbide may be cast carbide or a monotungsten carbide. In one or more embodiments, the plurality of hard particles of the erosion resistant matrix material may be pelletized ultrahard particles comprising an ultrahard particle (e.g., diamond grit) surrounded by a "shell" of metal carbide (e.g., tungsten carbide such as sintered tungsten carbide WC-Cobalt). Such pelletized particles have a particle size in the range of from 8 mesh to 30 mesh (about 600 microns to about 2400 microns), for example from 10 mesh to 18 mesh (about 1000 microns to about 2000 microns). The pelletized ultrahard particles may be spherical in shape. Examples of pelletized ultrahard particles are described in U.S. Pat. No. 7,350,599 and U.S. Patent Application Publication Nos. 2008/017421A1; 2008/0282618A1; and 2009/0120008A1, which are incorporated by reference herein in their entirety. In one or more embodiments, only a minor portion of the erosion resistant matrix material may contain ultrahard particles or pelletized ultrahard particles, suitably the erosion resistant matrix material may be substantially free of ultrahard particles or pelletized ultrahard particles.

In one or more embodiments, the cast carbide may be a cast tungsten carbide having a microhardness of at least 2500 kg/mm$^2$ ($HV_{0.3kg}$ Vickers Hardness), for example 3000 kg/mm$^2$, 3200 kg/mm$^2$, 3350 kg/mm$^2$, 3400 kg/mm$^2$, 3500 kg/mm$^2$, 3600 kg/mm$^2$, 3750 kg/mm$^2$, 3800 kg/mm$^2$, 3900 kg/mm$^2$, or 4000 kg/mm$^2$. The high hardness cast carbide may be spherical or non-spherical. Suitably, the high hardness cast tungsten carbide may have a high content of fine feather-like or acicular grains. Suitably, such feather-like structure may be obtained by rapid quenching of a carbide melt. Such high hardness cast tungsten carbides may also include SPHEROTENE® cast tungsten carbide having a hardness of greater than 3000 kg/mm$^2$, in particular in the range of from 3000 kg/mm$^2$ to 4000 kg/mm$^2$, which may be obtained from Technogenia, B.P. 151-Z.A. des Marais 74410 Saint-Jorioz France. Such high hardness cast tungsten carbide may also be further treated to form a dense shell of monotungsten carbide surrounding the cast tungsten carbide core, such as described in U.S. Pat. No. 7,541,090, which description is herein incorporated by reference.

In one or more embodiments, a spherical high hardness cast tungsten carbide may be crushed (comminuted) to form non-spherical particles. The spherical particles may be comminuted by high energy ball mill or high energy tumbling. The resulting non-spherical cast tungsten carbide particles may be used for the erosion resistant matrix material. The resulting non-spherical cast tungsten carbide particles may be affixed to surfaces within the mold cavity such that angular portions are adjacent the tool surface. Such configuration allows for greater contact with the surface onto which the particles are affixed within the mold cavity as compared with spherical particles or less angular particles. It is understood that any combination of hard particles may be used with the erosion resistant material.

Figure 7:
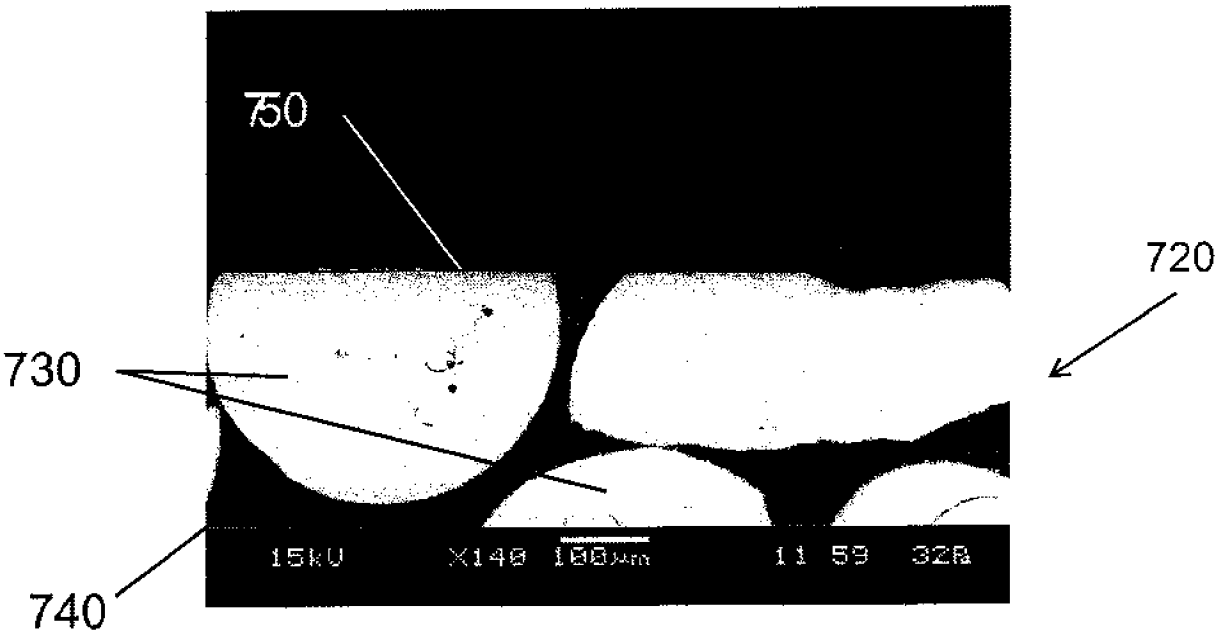
FIG. 7 is a SEM micrograph in accordance with one or more embodiments of the present disclosure.

FIG. 7 is a SEM micrograph depicting a first region 720 containing hard particles 730 which were affixed to the surface of the mold and infiltrated with a metal infiltration binder 740. The hard particles 730 were prepared by crushing (comminuting) spherical cast tungsten carbide particles having a high hardness, as described above. As can be seen, an advantage of crushing the spherical particles is that they may retain a portion of the spherical features but also provide for greater contact area 750 with the surface of the mold for better adhesion.

Suitably, a major portion of the erosion resistant matrix powder material may be cast tungsten carbide or a monotungsten carbide, preferably at least 75% w of the hard particles of the erosion resistant matrix powder material may be cast tungsten carbide or mono-tungsten carbide, more preferably at least 85% w, most preferably at least 95% w. The erosion resistant matrix material may have a median particle (grain) size in the range of from 250 to 1200 microns, suitably from 300 to 850 microns, more suitably from 350 to 500 microns. The median particle size may be calculated by analyzing photographs taken under magnification. The photographs should include numerous particles per image. Image analysis software may be used to measure the particle lengths. This method may be utilized for the powder materials as well as for the infiltrated matrix materials. For the infiltrated matrix materials, a polished cross-section is used for the analysis. The particle lengths may be taken along the longest length of the particle.

In one or more embodiments, a wear resistant matrix material may be affixed along one or more surfaces of the mold cavity in any location where the tool body rubs against the formation during drilling, for example along the top of the blades of a bit body behind the cutting elements. Rubbing along blade tops is a concern when drilling soft formations at high drilling speeds as this can cause high stress wear leading to a potential failure mode of the drill bit. Placement of a region of wear resistant matrix material along the blade tops (upper surface of the blades) helps to alleviate this high stress wear and thus improve the durability of the bit body. Methods of affixing the wear resistant material within the mold cavity may be the same as those described herein. The wear resistant matrix material may or may not be used in conjunction with an erosion resistant material affixed to other locations of the tool body.

Such wear resistant matrix material may comprise super-sized hard particles. Preferably, the super-sized hard particles may be non-spherical, having sharp corners and/or edges which may engage the formation during drilling. Such particles may have a particle size of at least 3000 microns, for example in the range of from 3000 microns to 7000 microns or from 3100 microns to 6500 microns, from 3200 to 6300 microns. Preferably, the super-sized hard particles comprise sintered tungsten carbide particles (e.g., tungsten carbide-cobalt), such as sintered tungsten carbide particles sold by B & W Metals, Houston, Tex. The wear resistant matrix material may also comprise one or more additional hard particles having particles sizes as described herein (1 micron to 1200 microns). The wear resistant matrix material may also comprise one or more supplemental metal binders, as described herein.

Figure 8:
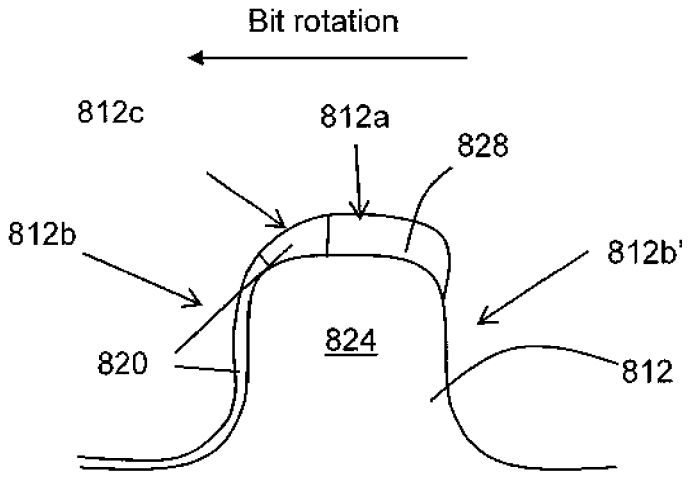
FIG. 8 shows a cross-sectional view of one or more embodiments of a blade along 3-3 of the bit of FIG. 1.

FIG. 8 illustrates a cross-section along 3-3 of a blade of a bit body taken between cutting elements. First matrix region 820 forms leading blade sidewall 812*b* and the area 812*c* between cutting elements. First matrix region 820 comprises an erosion resistant material. Fourth matrix region 828 forms a portion of blade top 812*a*. The fourth matrix region comprises a wear resistant matrix material, as described above. Second matrix region 824 forms the inner core and trailing sidewall 812*b*' of blade 812. The fourth matrix region comprising the wear resistant matrix material may have a thickness of at least 3000 microns, for example in the range of from 3000 microns to 10,000 microns, or from 3500 microns to 7000 microns.

As used herein, the thickness of a region adjacent a surface of the tool body may be measured perpendicular to the surface from the outermost extending point from the surface of the tool body to the innermost extending point interior of the tool body. The thickness is an average thickness for the particular region of the tool body.

A second matrix material which is positioned proximate the erosion resistant matrix material toward the interior of the tool body comprises a plurality of hard particles, as described herein. The plurality of hard particles of the second matrix powder material have a lower median particle size than the plurality of hard particles of the erosion resistant matrix powder material. Suitably, the median particle size of the hard particles of the second matrix powder material may be at least 50 microns less than the median particle size of the hard particles of the erosion resistant matrix material, for example at least 75 microns less, at least 100 microns less, 150 microns less, at least 200 microns less, at least 250 microns less, or at least 300 microns less. In one or more embodiments, the particle size distribution of the hard particles contained in the second matrix material may be wider (greater) than the particle size distribution of the hard particles contained in the erosion resistant matrix material (i.e., more narrow).

In one or more embodiments, the plurality of hard particles in the second matrix material may have particle sizes that may range from about 1 to 200 microns, suitably from about 1 to 150 microns, in particular from about 10 to 100 microns, for example from about 5 to 75 microns. In some example embodiments, the matrix hard particles of the second matrix powder material may be less than 50, 10, or 3 microns.

The second matrix material may have a greater toughness and/or strength (also referred to as transverse rupture strength) than the erosion resistant matrix material. This can maximize the strength and/or toughness of the tool body without having to sacrifice erosion resistance along one or more surfaces of the tool body.

In one or more embodiments, the hard particles of the first matrix material may have a greater average particle size as compared to the hard particles of the second matrix material, for example the average particle size of the first matrix material may be at least 1.5 times greater, at least 2 times greater, or at least 2.5 times greater than the average particle size of the second matrix material.

A first example of such a second matrix material is described in U.S. Pat. No. 6,287,360, which description is incorporated by reference herein, and which describes a matrix material comprising hard particles which comprise carburized tungsten carbide (10-125 microns) and supplemental metal binder. The hard particles may comprise carburized tungsten carbide (a substantial percentage, i.e., fifty percent or more, of the grains or particles are 10 to 125 microns in size) and cast tungsten carbide. The supplemental metal binder may be selected from Group VIIIB metals of the Periodic Table such as nickel, cobalt, iron, mixtures and alloys thereof, for example a nickel powder. Such supplemental metal binder may be any suitable size. Such supplemental metal binder may have an average particle size in the range of 35 to 55 microns. For example, the second matrix material may comprise 40 to 70% by weight (% w) (e.g., about 62% w) carburized tungsten carbide, 20 to 55% w (e.g., about 30% w) cast tungsten carbide, and 2 to 15% w (e.g., about 8% w) nickel and/or iron, based on the total weight of the second matrix powder to be infiltrated with an infiltration metal binder. The carburized tungsten carbide may have an average grain size in the range of from 20 to 125 microns. The average particle size is a Fisher Sub-Sieve Size (FSSS) value. An FSSS value of a powder may be obtained by the method as set forth in ASTM B330-88. An FSSS value indicates that a major portion of the measured particles fall within the range of that value.

A second example of a second matrix material is described in U.S. Pat. No. 7,250,069, which description is incorporated by reference herein, and which describes a matrix material comprising hard particles which comprise spherical sintered tungsten carbide and supplemental metal binder. The spherical sintered tungsten carbide may have an average particle size in the range of from 0.2 to 20 microns, in particular from 1 to 5 microns. The hard particles may also comprise cast tungsten carbide and monotungsten carbide. The supplemental metal binder may be selected from Group VIIIB metals of the Periodic Table such as nickel, cobalt, iron, mixtures and alloys thereof, such as a nickel or iron powder. Such supplemental metal binder powder may be of any suitable size. Such supplemental metal binder may have an average particle size in the range of from 5 to 55 microns such as a nickel powder having an average particle size in the range of from 5 to 25 microns. For example, the second matrix material may comprise 45 to 70% by weight (% w) spherical sintered tungsten carbide, 5 to 30% w cast tungsten carbide, 5 to 40% w carburized tungsten carbide, and 10 to 25% w metal powder (e.g., nickel), based on the total weight of the second matrix powder to be infiltrated with an infiltration metal binder. Additionally, although not disclosed in U.S. Pat. No. 7,250,069, the second matrix material may comprise 25 to 50% by weight (% w) spherical sintered tungsten carbide, 20 to 55% w cast tungsten carbide, 5 to 40% w carburized tungsten carbide, and 2 to 15% w metal powder (e.g., nickel), based on the total weight of the second matrix powder to be infiltrated with an infiltration metal binder.

A third example of a second matrix material is described in US Patent Application Publication No. 2007/0175669, which description is incorporated by reference herein, and which describes a matrix material comprising hard particles which comprise monotungsten carbide, sintered tungsten carbide, and cast tungsten carbide particles and a supplemental metal binder. The supplemental metal binder may be selected from Group VIIIB metals of the Periodic Table such as nickel, cobalt, iron, mixtures and alloys thereof. The supplemental metal binder may be present in an amount in the range of from 2 to 15% w, based on the total weight of the matrix material. The quantity of each tungsten carbide may be selected such that after formation the matrix material has a toughness of greater than 20 ksi($in^{0.5}$), and a transverse rupture strength of greater than 140 ksi. Methods of measuring transverse rupture strength and toughness are described in US 2007/0175669 see paragraphs 46-49, which are incorporated herein by reference. The monotungsten carbide may contain particles having a mesh size between 325 mesh and 625 mesh (−325/+625 mesh) (20 to 44 microns). The sintered tungsten carbide may contain particles having a mesh size between 170 mesh and 625 mesh (−170/+625 mesh) (20 to 88 microns). The cast tungsten carbide may contain particles having a mesh size between 60 mesh and 325 mesh (−60/+325 mesh) (44 to 250 microns). The hard particles may be spherical or non-spherical. The matrix material may also contain a supplemental metal binder such as a nickel or iron powder. For example, the second matrix material may comprise at most 30% w (e.g., from 22 to 28% w) monotungsten carbide, at most 40% w (e.g., from 22 to 28% w) sintered tungsten carbide, and up to 60% w (e.g., from 44 to 56% w) cast tungsten carbide, and optionally at most 12% w supplemental metal binder (e.g., nickel), based on the total weight of the second matrix powder to be infiltrated with an infiltration metal binder.

A fourth example of a second matrix material may consist essentially of a plurality of hard particles having a particle size distribution of ±20% of a median particle size and optionally a plurality of supplemental metal binder particles. Suitably, hard particles may have a particle size distribution of ±15% or ±10% of a median particle size. Suitably, at least 90%, for example at least 95%, of the plurality of the hard particles have a particle size within 20%, 15% or 10% of a median particle size of the plurality of hard particles. Suitably, the second matrix material of this embodiment, may have a mean particle size ranging from 100 to 200 microns, for example 125 to 175 microns. Suitably, the hard particles may be one or more metal carbide particles, as described herein, for example a tungsten carbide. Suitably, at least a portion of the hard particles may comprise spherical or non-spherical cast tungsten carbide.

In some embodiments, one or more different additional matrix materials may be used to form additional regions of the tool body. The additional matrix materials may be selected from those discussed above for the second matrix material. In an example embodiment, as discussed above with respect to FIG. 4, a third matrix material may be used to form one or more third regions 428. The third region may be proximate the cutting element forming at least a portion of the cutter pocket in the blade. The third region may comprise the rear portion of the cutter pocket (a portion of or the entire rear portion) corresponding to the end of the cutting element opposite the cutting face (e.g., diamond layer), the sides of the cutter pocket (a portion of or the entire side portion), the base of the cutter pocket (a portion of or the entire base portion), and combinations thereof. Suitably, the infiltrated third matrix material may have a greater toughness than other matrix regions of the tool body, suitably the toughness value of the third region may be at least 10 percent greater than other matrix regions of the tool body formed of other matrix materials, such as the first erosion resistant matrix material and the second matrix material, for example at least 20 percent greater. The toughness value of the third region may be in the range of from 10 to 50 percent greater than other matrix regions formed of other matrix materials, such as the first erosion resistant matrix material and the second matrix material. The toughness may be determined as described above.

Alternatively, or in addition, the third matrix material may have a greater transverse rupture strength than other matrix regions of the tool body, suitably the transverse rupture strength of the third region may be at least 20 percent greater than other matrix regions of the tool body formed of other matrix materials, such as the first erosion resistant matrix material and the second matrix material, for example at least 50 percent greater. The transverse rupture strength of the third region may be in the range of from 30 to 100 percent greater than other matrix regions formed of other matrix materials, such as the first erosion resistant matrix material and the second matrix material. The transverse rupture strength may be determined as described above.

Alternatively, or in addition, the third matrix material may have a greater braze strength than other regions matrix regions of the tool body, suitably the third matrix material has a braze strength that may be at least 10 percent greater than other matrix regions of the tool body, for example in the range of from 10 to 50 percent greater. If a matrix material does not provide sufficient braze strength, the cutting elements may be sheared from the bit body and the expensive cutting elements may be lost resulting in a decrease in performance of the bit. Suitably, the braze strength may be characterized as the force required to "push-out" a cutter brazed to a matrix material. One such test method is described in U.S. Pat. No. 6,287,360, which test method is incorporated by reference herein.

Further, in particular embodiments of the present disclosure, the third matrix material may use fine carbides, having an average particle size in the range of less than about 44 microns (to sub-micron or nano-size range), less than 20 microns, or less than 10 microns, or from about 0.1 to 6 microns in a particular embodiment. In one or more embodiments, the third matrix powder may also contain a supplemental metal binder as described herein. Use of such particles is described more fully in U.S. Patent Application Ser. No. 61/262,473, entitled "High Strength Infiltrated Matrix Body Using Fine Grain Dispersions,", filed concurrently herewith, which is assigned to the present assignee and herein incorporated by reference in its entirety. Specifically, the carbide particles having such fine size may be incorporated into granules (to form concentrated carbide zones), as described in such patent application, or they may be simply be incorporated into a moldable material without granulation. The fine carbides may be particularly suitable for use in a matrix body in regions adjacent the cutter pocket (detailed above in FIG. 4). Generally, when a cutting element is brazed in a cutter pocket, the heat fluctuations during the brazing process as well as during the sharp cool-down may result in micro-cracking in the carbide particles (coarser particles) along a line parallel to the braze joint. Such small micro-cracks can then grow into larger cracks upon use. Conversely, when a matrix powder with fine carbides are used, as in the present disclosure, such micro-cracks during brazing may be avoided, resulting in a bit being put into the field with less susceptibility for failure. In particular, the carbide particles are so fine that the particles themselves are resistant to cracking. Additionally, there is also a sufficient amount of metal surrounding the fine carbides to also minimize cracking. Such strength may also be desirable at the base of the blade, as described above, with first matrix regions forming other portions of the bit body surface.

The one or more regions of the erosion resistant matrix material in the infiltrated tool body may have a final metal binder content (infiltrant and powder) in the range of from 30 to 50% by volume (% v), suitably from 35 to 45% v, with a hard particle content in the range of from 50 to 70% v, suitably from 55% to 65% v. An alternative way of expressing the final metal binder content may be done by looking at the area fraction, which, may be estimated, for example, from back-scatter scanning electron microscopy (SEM) of a resulting matrix body. Further, with a sufficient number of cross-sections, one skilled in the art would appreciate that the volume fraction may be calculated from the area fraction. Another method of measuring the metal binder content may include use of various quantitative methods which chemically removes or dissolves the metal binder from the infiltrated matrix material and then analytically measures the metal content using for example AA (atomic absorption spectrometer), ICP/AES (inductively coupled plasma/atomic emission spectrometer), or ICP/MS (inductively coupled plasma/mass spectrometer) instrumentation.

The one or more regions of second matrix material in the infiltrated tool body may have a final metal binder content (infiltrant and any supplemental metal binders) in the range of from 35 to 60% by volume (% v), suitably from 40 to 50% v, with a hard particle content in the range of from 40 to 65% v, suitably from 50% to 60% v. The volume percent of the final metal binder content may be less for the erosion resistant matrix material than the second matrix material. Suitably, the final metal binder content of the erosion resistant matrix material may be at least 5% v less than the other matrix materials used to form the tool body, more suitably at least 10% v less.

The thickness of the one or more infiltrated first regions of erosion resistant matrix material may be in the range of from 250 microns to 6500 microns, suitably from 275 microns to 4000 microns, more suitably from 300 microns to 3600 microns, for example from 350 microns to 2400 microns, from 400 microns to 1500 microns, or about 1000 microns in thickness. Desired thickness may be based in part on the size of the hard particles being used. Suitably, the relatively "thin" one or more first matrix regions of erosion resistant material may be of a substantially uniform thickness, meaning that at least 75% of the infiltrated first region varies in thickness by no more than 50%, for example no more than 25%.

In one or more embodiments, the first region of erosion resistant matrix material may be designed such that the first region is present during the first drilling run for a sufficient period of time to protect the underlying matrix material. During the bit rebuilding process where the worn cutting elements are replaced, the underlying matrix material is now at the bit surface. Advantageously, the surface of the bit in this embodiment is substantially free of the coarse hard particles from the erosion resistant matrix material during the brazing repair and replacement of cutting elements. The heat generated during brazing may potentially cause the used coarse hard particles from the erosion resistant matrix material to crack which can propagate into the underlying matrix material leading to premature failure of the underlying matrix material. Thus, an improved bit body for the rebuilt bit may be provided in that the underlying matrix material may be in better condition than otherwise possible if the erosion resistant matrix material was not utilized during the first drilling run. The rebuilt bit may be advantageously used in a less abrasive drilling application.

A difference between matrix materials used in certain portions of a tool body may include variations in chemical make-up or particle size ranges/distribution, which may translate, for example, into a difference in properties such as toughness/strength. Thus, for example, different types of carbide (or other hard) particles may be used among the different types of matrix materials. One of ordinary skill in the art should appreciate after learning the teachings related to the present disclosure that a particular variety of tungsten carbide, for example, may be selected based on toughness/strength. Further, chemical make-up of a matrix powder material may also be varied by altering the percentages/ratios of the amount of hard particles as compared to metal binder powder. Thus, by decreasing the amount of tungsten carbide particle and increasing the amount of metal binder powder in a portion of the bit body, a softer portion may be obtained, and vice versa.

In some embodiments, as the molten infiltration metal binder infiltrates the matrix materials, it may capture and transport some of the smaller hard particles within the molten infiltration metal binder such that the infiltration metal binder may include hard particles (e.g., carbides) in amounts ranging from 0 to 70% by weight in addition to at least one metal binder in amount ranging from 30 to 100% by weight thereof to facilitate bonding of matrix material.

Types of Tungsten Carbide

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 microns, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996; 5,089,182; and 7,541,090, which methods are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC (mono-tungsten carbide). Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of mono-tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

In one or more embodiments, hard particles of fine monotungsten carbide powder may also be used, such as in embodiments where a fine microstructure is desired (e.g., less than 44 microns, less than 20 microns or less than 10 microns in various embodiments).

EXAMPLES

Example 1

An erosion resistant matrix material was infiltrated with an infiltrating binder. The erosion resistant matrix material contained 94% w spherical cast tungsten carbide (which was subsequently crushed) and 6% w nickel powder. The spherical cast tungsten carbide was of greater hardness than other carbides used in the comparative examples. A major portion (by weight) of the spherical cast tungsten carbide particles before crushing had a mesh size of approximately 40 mesh (400 microns).

Comparative Example 2

A second matrix material was infiltrated with a similar infiltrating binder as used in Example 1. The matrix material contained 92% w of non-spherical cast tungsten carbide and 8% w nickel powder. A major portion (by weight) of the non-spherical cast tungsten carbide had a mesh size of approximately 100 mesh (149 microns).

Comparative Example 3

A third matrix material was infiltrated with a similar infiltrating binder as used in Example 1. The matrix material contained 92% w carbide and 8% w nickel powder. The carbide comprised 62% w of carburized tungsten carbide and 30% w of non-spherical cast tungsten carbide, based on the total weight of the third matrix material. A major portion (by weight) of the tungsten carbides had a mesh size of approximately less than 200 mesh (<74 microns).

The three matrix materials were subjected to an erosion test performed in accordance to ASTM G76. The results of the erosion test are summarized in Table I below.

TABLE I

| Example: | Normalized Erosion Number |
|---|---|
| 1 | 1.86 |
| 2 | 4.54 |
| 3 | 12.30 |

As observed from the results of the erosion tests, the erosion resistant matrix material provides superior erosion resistance compared to the matrix materials of Examples 2 and 3, in particular a 59% improvement in erosion resistance compared to Example 2 and a 85% improvement in erosion resistance compared to Example 3.

One of ordinary skill in the art should appreciate after learning the teachings related to the present disclosure that various tools besides PDC fixed cutter drill bits may use the matrix tool bodies of the present disclosure. Such tools may include roller cone drill bits, diamond impregnated bits, hammer/percussion bits, reamers, stabilizers, hole openers, downhole tool sleeves (which are welded to a bit), and mining bits.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for manufacturing a matrix tool body comprising:

placing a first matrix material comprising a plurality of hard particles within a first region of a mold cavity proximate a surface of the mold using an adhesive, wherein the plurality of hard particles of the first matrix material have sizes in the range of from 16 mesh to 60 mesh and have a median particle size, wherein said particles adhere to the mold surface and voids are defined between said particles adhered to the mold surface;

subsequently placing a second matrix material comprising a plurality of hard particles within a second region of the mold cavity positioned inwardly of the first matrix material and in said voids, wherein the plurality of hard particles of the second matrix material have a median particle size that is less than the median particle size of the plurality of hard particles of the first matrix material; and infiltrating the hard particles of the first matrix material and second matrix material with an infiltration binder to form the tool body.

2. The method of claim 1, wherein the plurality of hard particles of the first matrix material have sizes in the range of from 20 mesh to 50 mesh.

3. The method of claim 1, wherein the plurality of hard particles of the first matrix material have sizes in the range of from 35 mesh to 45 mesh.

4. The method of claim 1, wherein the plurality of hard particles of the first matrix material comprise metal carbide particles.

5. The method of claim 4, wherein at least a portion of the metal carbide particles are spherical in shape.

6. The method of claim 5, wherein the metal carbide particles comprise spherical metal carbide particles and non-spherical metal carbide particles.

7. The method of claim 4, wherein the plurality of hard particles comprise tungsten carbide.

8. The method of claim 7, wherein the tungsten carbide comprises cast tungsten carbide or mono-tungsten carbide.

9. The method of claim 8, wherein a major portion of the tungsten carbide is cast tungsten carbide.

10. The method of claim 9, wherein the cast tungsten carbide is spherical and has a microhardness of at least 2500 $kg/mm^2$.

11. The method of claim 10, wherein the cast tungsten carbide is prepared by comminuting the spherical cast tungsten carbide to form non-spherical cast tungsten carbide.

12. The method of claim 1, wherein the method further comprises placing the adhesive along a surface of the mold cavity within the first region; introducing the first matrix material in the form of a powder into the mold cavity; and spreading the first matrix material around the mold to attach to the surfaces containing the adhesive.

13. The method of claim 12, the method further comprises allowing the adhesive to dry before placing the second matrix material into the mold cavity.

14. The method of claim 1, wherein the method further comprises mixing the adhesive with the first matrix material; and placing the mixture onto a surface of the mold cavity within the first region.

15. The method of claim 1, wherein the method further comprises placing the adhesive along a surface of an organic medium; introducing the first matrix material in the form of a powder onto the medium such that the first matrix material attaches to the surface of the organic medium; placing a second adhesive along a surface of the mold cavity within the first region; and placing the organic medium along the surface of the mold cavity within the first region.

16. The method of claim 15, wherein the adhesive used to attached the first matrix material onto the organic medium is different from the second adhesive used to attach the organic medium to the surface of the mold cavity.

17. The method of claim 15, wherein the first matrix material is attached to the organic medium prior to attaching the organic medium to the surface of the mold cavity.

18. The method of claim 15, wherein the organic medium comprises paper having a pattern printed thereon for placement of the first matrix material.

19. The method of claim 1, wherein the method further comprises mixing the adhesive with the first matrix material; forming the mixture into clusters of the first matrix material; and drying the clusters.

20. The method of claim 19, wherein the method further comprises placing the clusters into the mold cavity within a first region.

21. The method of claim 20, wherein the method further comprises placing an adhesive along a surface of the mold cavity within the first region; and spreading the clusters around the mold cavity to attach to the surfaces containing the adhesive.

22. The method of claim 1, wherein the method further comprises using an adhesive to secure a portion of a hook and loop fastener along a surface of the mold cavity within the first region; and introducing the first matrix material into the loops and/or hooks of the hook and loop fastener to mechanically hold the first matrix material within the mold cavity.

23. The method of claim 1, wherein the tool body is a bit body and the first region may be selected from the group consisting of a blade top, a leading side of the blade, a trailing side of the blade, an upper surface of a gage pad, a leading side of a gage pad, a trailing side of a gage pad, an area proximate a nozzle, and combinations thereof.

24. The method of claim 23, wherein the first matrix region is positioned along a portion of the leading side of the blade; the second matrix region is positioned within the interior of the blade; and a third matrix material comprising a plurality of hard particles placed within a third region of the mold cavity proximate the surface of the mold which forms the top of the blade using an adhesive, wherein the plurality of hard particles of the third matrix material comprise non-spherical sintered metal carbide having sizes of greater than 3000 microns, and wherein the plurality of hard particles in the third matrix material have a greater median particle size than the first matrix material.

25. The method of claim 1, wherein the plurality of hard particles of the second matrix material comprise one or more of metal carbides, wherein the one or more metals of the metal carbides may be selected from tungsten, molybdenum, vanadium, chromium, titanium, tantalum, niobium, and combinations thereof.

26. The method of claim 1, wherein the adhesive is selected from the group of a rubber-based adhesive, an epoxy adhesive, a silicon adhesive, an acrylic adhesive, an acrylate adhesive, a polyurethane adhesive, a polyvinyl acetate adhesive, and combinations thereof.

27. The method of claim 1, wherein the plurality of hard particles of the second matrix material consists essentially of hard particles having a particle size distribution of ±20% of a median particle size and a supplemental metal binder.

28. The method of claim 1, wherein the tool is a fixed cutter drill bit.

29. A method for manufacturing a matrix tool body comprising:

placing a first matrix material comprising a plurality of hard particles within a first region of a mold cavity proximate a surface of the mold using an adhesive, wherein the plurality of hard particles of the first matrix material have sizes in the range of from 16 mesh to 60 mesh and have a median particle size and wherein placing a first matrix material within the first region of the mold cavity proximate the surface of the mold using an adhesive comprises:

placing the adhesive along a surface of an organic medium, introducing the first matrix material in the form of a powder onto the medium such that the first matrix material attaches to the surface of the organic medium, placing a second adhesive along a surface of the mold cavity within the first region, placing the organic medium along the surface of the mold cavity within the first region;

subsequently placing a second matrix material comprising a plurality of hard particles within a second region of the mold cavity positioned inwardly of the first matrix material, wherein the plurality of hard particles of the second matrix material have a median particle size that is less than the median particle size of the plurality of hard particles of the first matrix material; and infiltrating the hard particles of the first matrix material and second matrix material with an infiltration binder to form the tool body, wherein the organic medium comprises paper having a pattern printed thereon for placement of the first matrix material.

30. A method for manufacturing a matrix tool body comprising:

placing a first matrix material comprising a plurality of hard particles within a first region of a mold cavity proximate a surface of the mold using an adhesive, wherein the plurality of hard particles of the first matrix material have sizes in the range of from 16 mesh to 60 mesh and have a median particle size;

subsequently placing a second matrix material comprising a plurality of hard particles within a second region of the mold cavity positioned inwardly of the first matrix material, wherein the plurality of hard particles of the second matrix material have a median particle size that is less than the median particle size of the plurality of hard particles of the first matrix material; and infiltrating the hard particles of the first matrix material and second matrix material with an infiltration binder to form the tool body, wherein the method further comprises mixing the adhesive with the first matrix material; forming the mixture into clusters of the first matrix material; and drying the clusters.

31. A method for manufacturing a matrix tool body comprising:

placing a first matrix material comprising a plurality of hard particles within a first region of a mold cavity proximate a surface of the mold using an adhesive, wherein the plurality of hard particles of the first matrix material have sizes in the range of from 16 mesh to 60 mesh and have a median particle size;

subsequently placing a second matrix material comprising a plurality of hard particles within a second region of the mold cavity positioned inwardly of the first matrix material, wherein the plurality of hard particles of the second matrix material have a median particle size that is less than the median particle size of the plurality of hard particles of the first matrix material; and infiltrating the hard particles of the first matrix material and second matrix material with an infiltration binder to form the tool body, wherein the tool body is a bit body and the first region may be selected from the group consisting of a blade top, a leading side of the blade, a trailing side of the blade, an upper surface of a gage pad, a leading side of a gage pad, a trailing side of a gage pad, an area proximate a nozzle, and combinations thereof, wherein the first matrix region is positioned along a portion of the leading side of the blade; the second matrix region is positioned within the interior of the blade; and a third matrix material comprising a plurality of hard particles placed within a third region of the mold cavity proximate the surface of the mold which forms the top of the blade using an adhesive, wherein the plurality of hard particles of the third matrix material comprise non-spherical sintered metal carbide having sizes of greater than 3000 microns, and wherein the plurality of hard particles in the third matrix material have a greater median particle size than the first matrix material.

* * * * *